US005154780A

United States Patent [19]

Premkumar

[11] Patent Number: 5,154,780

[45] Date of Patent: Oct. 13, 1992

[54] METALLURGICAL PRODUCTS IMPROVED BY DEFORMATION PROCESSING AND METHOD THEREOF

[75] Inventor: M. K. Premkumar, Monroeville, Pa.

[73] Assignee: Aluminum Company of America, Pittsburgh, Pa.

[21] Appl. No.: 542,460

[22] Filed: Jun. 22, 1990

[51] Int. Cl.[5] ..... C22C 21/00

[52] U.S. Cl. ..... 428/553; 72/700; 75/249; 148/437; 148/514; 428/654

[58] Field of Search ..... 72/700, 253.1, 352, 72/199; 420/550; 75/249; 148/11.5 A, 437

[56] References Cited

U.S. PATENT DOCUMENTS

| | | | |
|---|---|---|---|
| 4,379,719 | 4/1983 | Hildeman et al. | 419/60 |
| 4,464,199 | 8/1984 | Hildeman et al. | 75/249 |
| 4,859,252 | 8/1989 | Masumoto et al. | 148/437 |
| 4,927,469 | 5/1990 | Rioja et al. | 148/11.5 A |
| 4,939,032 | 7/1990 | Petit et al. | 148/437 |

FOREIGN PATENT DOCUMENTS

| | | | |
|---|---|---|---|
| 53-144813 | 12/1978 | Japan | 148/327 |

OTHER PUBLICATIONS

"Microstructural Characterization of the Dispersed Phases in Al-Ce-Fe System", Metallurgical Transactions A, vol. 19A, Jul. '88, pp. 1645-1656.

S. H. Goods et al, Acta Met. vol. 27, pp. 1-14, 1979 "The Nucleation of Cavities" by Plastic Deformation.

Hoffman et al. "Introduction to the Theory of Plasticity for Engineers", McGraw-Hill Book Co, NY, 1953.

"Rotary Swaging of Bars and Tubes" Metals Handbook, 9th Ed, vol. 14, (ASM Intern., Materials Park, Oh).

*Primary Examiner*—Deborah Yee

*Attorney, Agent, or Firm*—Daniel A. Sullivan, Jr.

[57] ABSTRACT

This invention is characterized by working which improves metal formability. This is contrary to the usual result of working metals, where formability decreases during working.

22 Claims, 4 Drawing Sheets

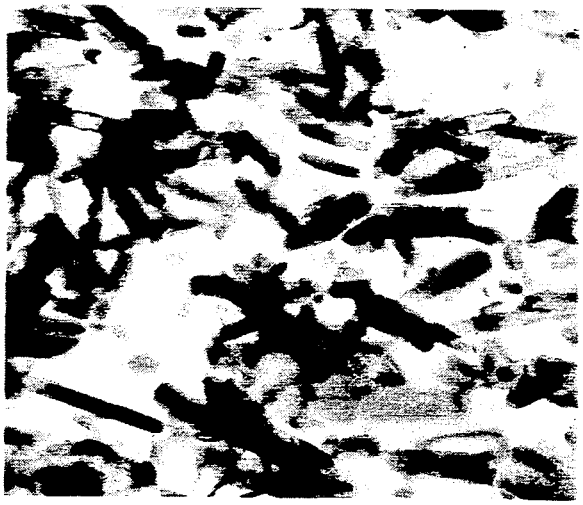
0.3 μm
FIG. 1 TEM micrograph of the longitudinal section of hot extruded Al-8%Fe-4%Ce powder metallurgy alloy. Extrusion temperature - 866 °F, extrusion ratio - 38:1.
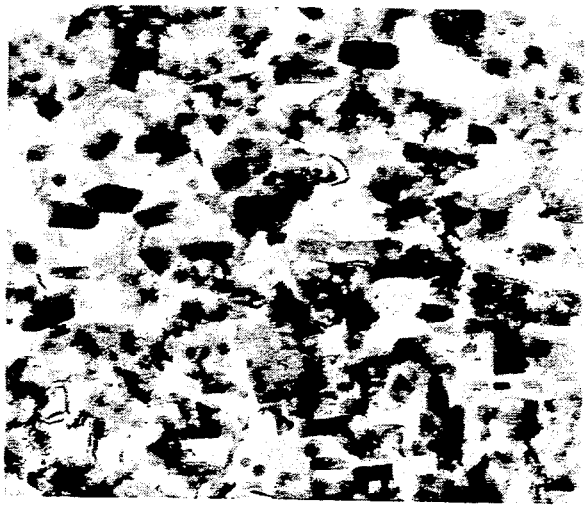
0.3 μm
FIG. 2 TEM micrograph of the longitudinal section of hot extruded and cold hydrostatically extruded Al-8%Fe-4%Ce powder metallurgy alloy. Extrusion temperature - 866 °F, extrusion ratio - 38:1, True cold strain - 2.8.

METALLURGICAL PRODUCTS IMPROVED BY DEFORMATION PROCESSING AND METHOD THEREOF

CONTRACT REFERENCE

This invention was made with Government support under Contract No. F33615-87-C-3248 awarded by the United States Air Force. The Government has certain rights in this invention.

TECHNICAL FIELD

This invention relates to metallurgical products improved by deformation processing. A particular application of the invention is provided in terms of dispersoid-strengthened alloys. The invention provides alloys of improved formability and processing for achieving such. An example of dispersoid-strengthened alloy to which the invention applies is provided by alloys of the category: ribbon, particulate, or powder metallurgy (P/M) processed Al-Fe-Ce alloys.

Formability and deformation are measured herein in terms of strain, and all strains are given in terms of true, or logarithmic, strain rather than engineering, or conventional, strain.

DISCLOSURE OF INVENTION

This invention provides improved metallurgical products and processing for achieving such improved products.

According to the invention, it has been discovered that formability of metallurgical products can be improved by a working process. As an example, cold working of Al-Fe-Ce alloy, preferably by a process which provides a compressive state of stress during the cold working, leads to improved formability.

BRIEF DESCRIPTION OF THE DRAWINGS

FIGS. 1 and 2 are transmission electron micrographs of Al-Fe-Ce alloy specimens.

MODES FOR CARRYING OUT THE INVENTION

Figure 3:
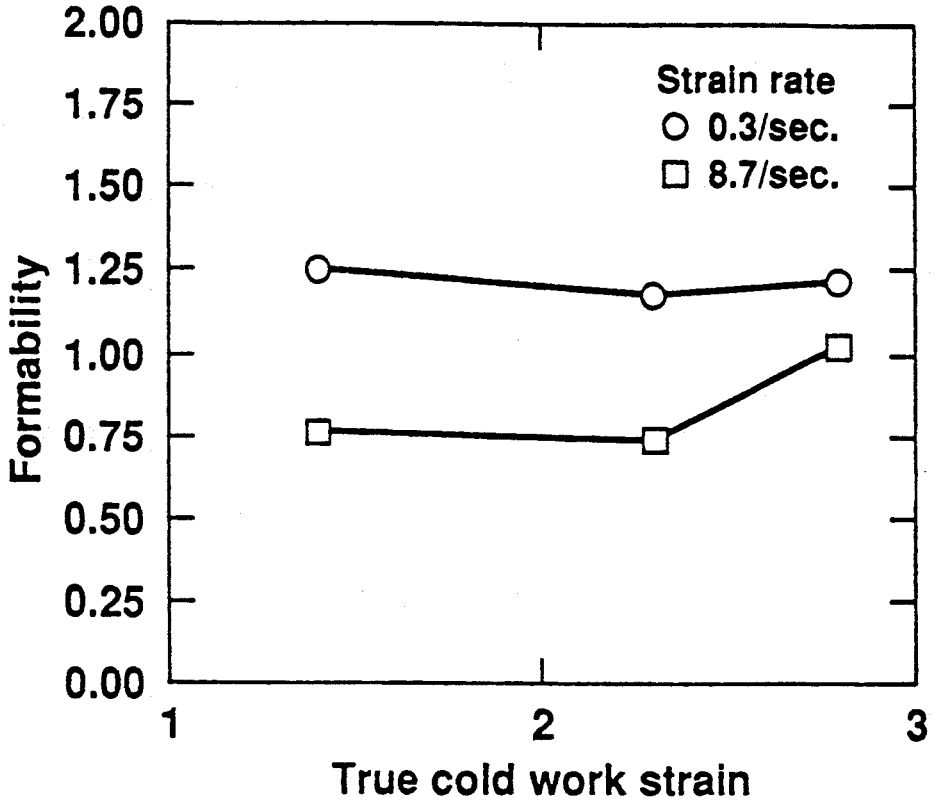
FIG. 3 is a graph of formability versus true strain.

Powder metallurgy (P/M) processed Al-Fe-Ce alloys in various product forms such as extrusions, forgings, plates and sheet hold promise for elevated temperature service in aerospace applications. One method of joining components fabricated from these alloys is by using fasteners such as rivets. An important requirement of the fastener alloy is that it must be compatible with the components in terms of strength and galvanic corrosion potential.

With respect to resistance to galvanic corrosion, there will certainly be none if the components and the fasteners are made of the same material, in which case they are neutral with respect to one another, i.e. there is a zero solution potential between them. Where there is some difference in the material of the components versus the material of the fasteners, it is preferred that the components have an anodic solution potential with respect to the fasteners and that the components be anodic by no more than 20 millivolts as measured in an aerated 1-molar NaCl solution and by no more than 50 millivolts when measured in an aerated 3½wt.-% NaCl solution.

The present invention provides fastener/rivet stock Al-Fe-Ce alloy acceptable with respect to strength and with respect to formability for joining components, for instance sheet and/or plate components themselves of Al-Fe-Ce alloy.

Al-Fe-Ce alloy preferred for use in the present invention consists essentially of 4 to 12 wt.-% Fe, 2 to 14 wt.-% Ce, remainder substantially Al. An Al-Fe-Ce alloy subgroup has the iron and cerium contents 6 to 10 wt.-% Fe and 2 to 9 wt.-% Ce. Further information concerning this alloy is contained in U.S. Pat. Nos. 4,379,719, 4,464,199 and 4,927,469.

A primary goal of the present invention was to increase the formability limits of previous forms of Al-Fe-Ce alloy. The present invention provides a processing approach to produce Al-Fe-Ce fastener stock with improved formability, and particularly with an improved high-strain-rate formability coupled with little loss in strength.

Al-Fe-Ce alloys are dispersion strengthened alloys. They are effectively strengthened by a relatively large volume fraction of dispersoids. Rapid solidification during atomization results in formation of binary (Al-Fe) and ternary (Al-Fe-Ce) intermetallics which provide the dispersoids and affect the mechanical properties of the alloy. During consolidation of the powders by vacuum hot pressing and hot extrusion, the original solidification microstructure is altered. New dispersoids are formed, for instance metastable phases transform to more stable phases (which may, however, still be metastable), and there is a redistribution of dispersoids. The dispersoids serve to stabilize a subgrain structure which develops in the matrix.

According to the invention, formability of Al-Fe-Ce is improved by cold work imparted preferably by a process which utilizes a compressive state of stress during the cold working. To achieve this, the center of the Mohr diagram must be sufficiently in the compressive region that no tensile stresses exist in the material. For further information on the Mohr diagram, see *Theory of Plasticity,* by Hoffman and Sachs (McGraw-Hill Book Co., New York, 1953).

I theorize that my invention operates to improve formability of the extruded alloy by altering the shape of the dispersoids. S. H. Goods and L. M. Brown, ACTA Met. Vol. 27, Page 1, 1979, indicate that cavity formation occurs differently, depending on the aspect ratio of particulate inhomogeneties in material being plastically deformed.

In support of my theory, I have noticed a change in aspect ratio between starting material and material of improved formability formed according to the invention. Thus, FIG. 1 shows a transmission electron microscope (TEM) micrograph of a hot extruded Al-8.3 wt.-% Fe-4 wt.-% Ce alloy where the dispersoids are observed to be elongated. It is my understanding that the elongated dispersoids are formed during the hot extrusion process. I believe them to be $Al_{20}Fe_5Ce$; see, for instance, page 1648 of the article by Ayer et al., "Microstructural Characterization of the Dispersed Phases in Al-Ce-Fe System", Metallurgical Transactions A, Vol. 19A, July 1988, pp1645–56 (a publication of AIME). FIG. 2 shows the same hot extruded material which has been subsequently cold worked by hydrostatic extrusion (a compressive stress state). In comparison to FIG. 1, the microstructure of FIG. 2 is more uniform and the elongated dispersoids have been broken down and distributed as smaller, more equiaxed particles. The use of compressive hydrostatic stresses during the cold working aids by healing any voids created by the working.

FIG. 3 shows that cold extrusion strain has to be above a certain level, before formability can be increased according to the invention. The level which needs to be exceeded in any given instance can be determined experimentally. The formability in FIG. 3 is reported versus true cold work strain in a hydrostatic extrusion process. A description of the hydrostatic extrusion process is presented on pages 327 −9 in *Metals Handbook,* 9th Edition, Vol. 14, "Forming and Forging", (ASM International, Materials Park, Ohio), which description is incorporated here by reference. True cold work strain is determined either on the basis of original diameter $d_o$ relative to final diameter $d_f$, or final length $l_f$ relative to original length $l_o$. In the case of diameters, the formula is $\ln(d_f^2/d_o^2)$, while for length it is $\ln(l_f/l_o)$ Based on the principle of constancy of volume, both formulae give the same answer. Formability is likewise expressed in terms of true strain, $\ln(d_m^2/d_o^2)$, where $d_m$ is the maximum formable rivet head diameter without cracking and $d_o$ is the original rivet stock diameter. Formability was determined in tests in which rivet stock of 0.185-inch diameter was placed with sliding fit in holes in plate material, with a flat head being formed from a 0.185-inch length of stock protruding from the hole. At low strain rates during rivet head formation there is a small change in formability. At high strain rates, however, the formability increases significantly in the case of material which has experienced a true cold hydrostatic extrusion strain of about 2.8. Thus, from a formability in the hot extruded condition of essentially about 0.76, formability increases to about 1.03 after a cold work strain of 2.8. At the same time, the yield strength of the alloy increases by 40% over its as-hot-extruded value at a cold extrusion strain of about 1.4 and remains about the same at higher levels of strain. High strain rate formability is particularly important as most commercial riveting operations occur at higher strain rates in order to increase productivity.

Thus, imparting cold work by hydrostatic extrusion alters the microstructure from that seen in FIG. 1 to that in FIG. 2 resulting in an increase in strength and high strain rate formability.

Among the parameters affecting the invention, hot extrusion temperature and extrusion ratio (area reduction ratio, or ) are important in establishing the state of the material which is then altered by the cold work. Level of cold work is also an important parameter. After a detailed study of various combinations of extrusion temperature and cold work strain, the recommended process parameter to produce Al-8.3 wt.-% Fe-4 wt.-% Ce alloy rivet stock with good strength and formability are:

Hot extrusion temperature about 465° C. (865° F.)

Hot extrusion ratio >38:1

Cold work strain >2.8

I am aware that there is in the literature another instance of working for breaking up rod-like intermetallics. Thus, in U.S. Pat. No. 3,989,548, hot or cold working is used to produce dispersion strengthened alloys from cast aluminum alloys. There, the objective was to break up a eutectic solidification structure to produce a dispersion of intermetallic particles. In the work reported in 3,989,548, the rod-like intermetallics in the cast alloy had aspect ratios substantially greater than 100:1, and these were brought into the range of 1:1 to 5:1 by the working. In my experiments with Al-Fe-Ce alloy as reported herein, the rods formed by the hot extrusion tend to have aspect ratibs of around 5:1, and the cold working which I apply breaks these down to more equiaxed particles. Thus, I prefer to achieve aspect ratios as close to 1:1 as possible. As a rule, the particles after cold working in my experiments will fall in the aspect-ratio range 1:1 to 2:1.

Besides the Al-8.3 wt.-% Fe-4 wt.-% Ce alloy detailed here, the same processing concept can be employed to improve formability of similar Al-Fe-Ce alloys and alloys belonging to this class as well as particulate or whisker reinforced metal matrix composites. With the knowledge that cold deformation can be characterized by increasing formability, tests of other metal systems will point out others to which the principles of the invention can be applied.

Besides hydrostatic extrusion, the cold work can also be imparted by other processes such as rolling and swaging which also produce compressive stress states. In preliminary tests, hot extruded Al-8.3 wt.-% Fe-4 wt.-% Ce alloy was swaged to rivet stock diameters. These tests indicate essentially equivalent results to those achieved with hydrostatic extrusion. These preliminary swaging tests were performed using a No. 5 Fenn swaging machine, which is a rotary spindle, alternate blow, swaging machine using a 12 roll roll cage, with 4 hammers and 4 dies, essentially as described on page 14–9 and as shown in FIG. 14–12 of *Tool and Manufacturing Engineer's Handbook,* Vol. 2, 4th Edition (Society of Manufacturing Engineers, Dearborn, Mich.), which page and figure are incorporated here by reference.

Swaging lends itself better to producing commercial quantities of rivet stock as opposed to hydrostatic extrusion.

The basic concept also has broader applicability than the production of rivet stock, and can be extended to other product forms such as rolled sheet. For example, hot rolling Al-Fe-Ce alloys followed by sufficient level of cold rolling would also result in more formable sheet.

Further illustrative of the invention is the following example:

EXAMPLE

Billets of alloy, INNOMETAL TM X8019, produced by Aluminum Company of America, of nominal composition Al-8.3 wt.-% Fe-4.0 wt.-% Ce was used for this example. The material was produced by atomization of pre-alloyed powders, cold consolidation and vacuum hot pressing at 426° C. to yield fully dense billets. (The temperature level of 426 comes about because 800° F. was the temperature reading used in the experiment; thus, there is no intent to ascribe any special importance to 426 as opposed to 425. Similar considerations hold for the other ° C. values reported herein.) The billets were then hot extruded to billet of reduced cross section at various temperatures ranging from 426°–500° C. with an area reduction ratio of 38:1 (true strain = 3.6). The extruded rods were then cold worked by hydrostatic extrusion to impart true deformation strains from 1.4–2.8, thus resulting in several combinations of hot extrusion temperature and subsequent cold deformation strain. In each case, final rivet stock diameter was 0.185". The different strains were achieved by starting with different original billet diameters. In the case of the 2.8 true cold work strain, a 0.75-inch diameter billet was reduced to the 0.185" final diameter using a reduction schedule of 0.5/0.375/0.29/0.185", thus 4 dies of progressively smaller inner diameter. In all stages, average product velocity, i.e. the average velocity of the material on the outlet side of the die, was in the range 1–4 inches/minute. In the case of the 1.4 strain, the starting billet diameter was 0.375", so only the 0.29 and 0.185" dies were used.

Figure 4:
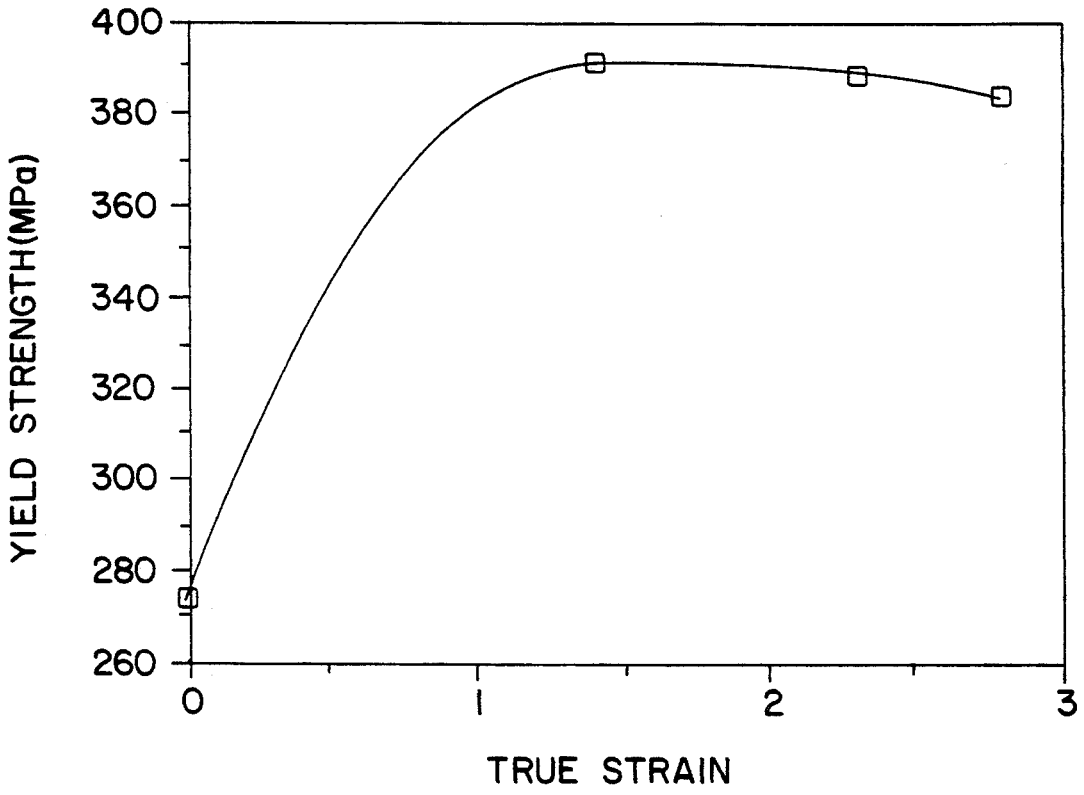
FIG. 4 is a graph of yield strength versus true strain.

Tensile tests, 0.125" gage diameter and 0.5" gage length, were conducted on the hot extruded and the final cold worked rods. Room temperature and elevated temperature shear tests were performed on the final rivet stock according to ASTM B565. The formability of the rivet stock was evaluated at room temperature under two different strain rate conditions. Rivets were formed by a hydraulic technique which is a low strain rate (0.3 $sec^{-1}$) process and by a low voltage electromagnetic riveter which results in high strain rates (8.7 $sec^{-1}$). The results are reported in FIGS. 3 and 4 and in tabular form below.

The yield strength and elongation of the as-extruded rod for the different extrusion temperatures are listed in Table I. With increasing extrusion temperature, the strength decreases although there is no significant change in ductility.

The effects of extrusion temperature and cold work strain combinations on strength and elongations of the rivet stock are presented in Table II and comparison of these data with those in Table I reveals a large increase in yield strength with no loss of ductility due to cold work. The cold work strain hardens the hot extruded alloy and increases its strength and also has a beneficial effect on ductility. For a given level of cold strain (e.g., 2.3), strength decreases with increasing prior extrusion temperature. It is believed this is due to the dispersoid size increasing with temperature. With increasing strain at a prior extrusion temperature of 463° C., strength remains essentially constant, as the alloy work hardens rapidly at very low strains and then shows no further work hardenability.

Table III shows data on the influence of process parameters on formability of the rivet stock at low and high strain rates. Extrusion temperature and subsequent cold work strain have no significant effect on formability at low strain rates but influence it at high strain rates. As the extrusion temperature increases for a constant strain level (2.3), high strain rate formability increases. It is believed this is due to coarsening of the dispersoids as temperature increases. The formability also increases with increasing strain for a given extrusion temperature (463° C.). This is believed to be due to fracture of rod like dispersoids into more equiaxed particles and the better distribution of these particles with increasing strain. The hydrostatic compressive stresses present during cold work prevent failure and heal the matrix. Bringing these concepts together, the prior hot extrusion temperature is important in obtaining an appropriate initial dispersoid size and aspect ratio for the fracture mechanism to operate during cold extrusion, and the level of cold strain during cold extrusion is important for uniform distribution of the fractured particles.

Figure 5:
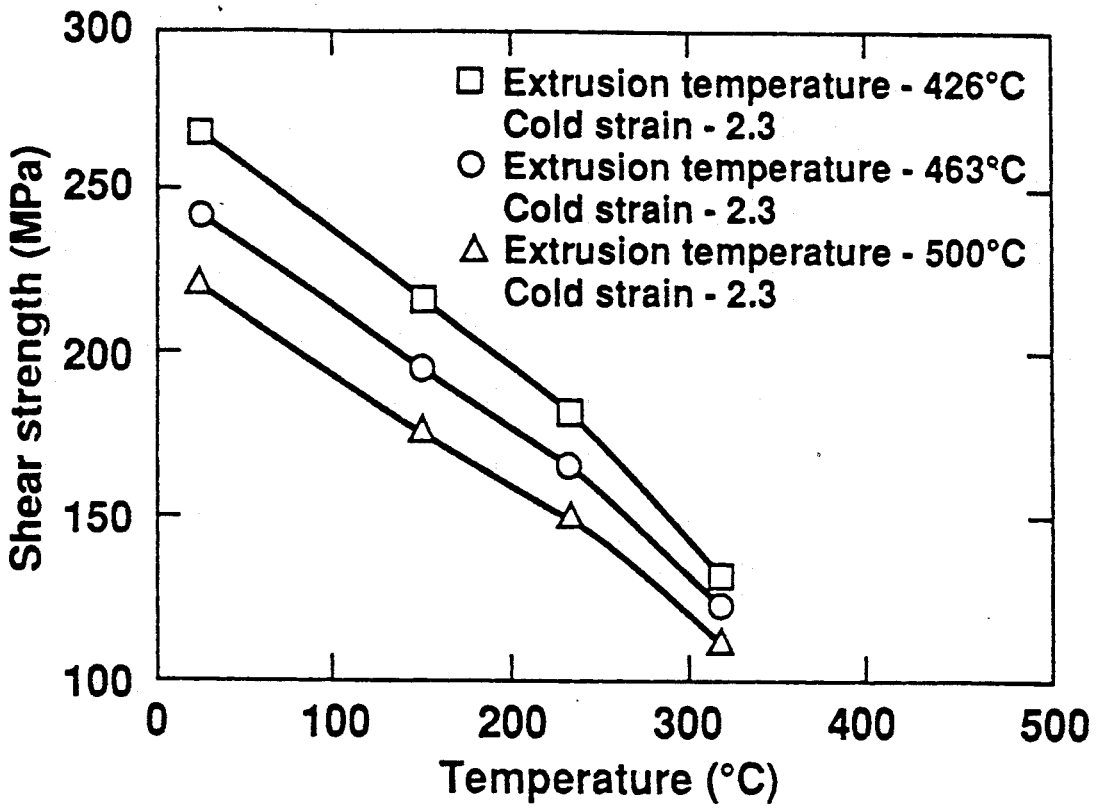
FIG. 5 is a graph of shear strength versus temperature.

The hot extrusion temperature-cold strain combination influences dispersoid size and distribution which affects the magnitude of the room temperature shear strength of the rivet stock. Strength retention at elevated temperatures, however, is not dependent on the process parameters investigated here. This is illustrated in FIG. 5 which shows the same trend of decreasing strength with temperature for three different processing conditions although the room temperature shear strength values are different.

TABLES

TABLE I

Effect of Extrusion Temperature on Yield Strength and Ductility of Hot-Extruded Al-8.3 wt. % Fe-4.0 wt. % Ce Alloy

| Extrusion Temperature (°C.) | Yield Strength (MPa) | True Fracture Strain |
|---|---|---|
| 426 | 302 | 0.29 |
| 463 | 274 | 0.36 |
| 500 | 238 | 0.33 |

TABLE II

Influence of Process Parameters on Strength and Ductility of Cold-Worked Al-8.3 wt. % Fe-4.0 wt. % Ce Alloy

| Extrusion Temperature (°C.) | Cold Work Strain | Yield Strength (MPa) | Shear Strength (MPa) | True Fracture Strain |
|---|---|---|---|---|
| 426 | 2.3 | 422 | 268 | 0.83 |
| 463 | 1.4 | 391 | 249 | 0.73 |
| 463 | 2.3 | 389 | 246 | 0.80 |
| 463 | 2.8 | 384 | 244 | 0.86 |
| 500 | 2.3 | 335 | 220 | 0.79 |

TABLE III

Influence of Process Parameters on Formability of Cold-Worked Al-8.3 wt. % Fe-4.0 wt. % Ce Alloy

| Extrusion Temperature (°C.) | Cold Work Strain | Formability | |
|---|---|---|---|
| | | Strain Rate 0.3 $sec^{-1}$ | Strain Rate 8.7 $sec^{-1}$ |
| 426 | 2.3 | 1.16 | 0.59 |
| 463 | 1.4 | 1.25 | 0.76 |
| 463 | 2.3 | 1.18 | 0.74 |
| 463 | 2.8 | 1.22 | 1.03 |
| 500 | 2.3 | 1.18 | 0.99 |

I claim:

1. A method comprising:

providing an aluminum alloy having a structure which includes intermetallic rods and being in a state in which working of the alloy is accompanied by an increase in formability; and working the provided alloy to bring about an increase in formability, the working reducing the intermetallic rods to particles in the aspect ratio range of about 1:1 to about 2:1.

2. A method as claimed in claim 1, wherein the alloy is in the form of consolidated ribbon, particles or powder.

3. A method as claimed in claim 1, wherein the metal comprises dispersion hardened metal.

4. A method as claimed in claim 3, wherein the metal is an Al-Fe-Ce alloy.

5. A method as claimed in claim 1, wherein the working utilizes a compressive state of stress.

6. A method as claimed in claim 5, wherein a compressive hydrostatic state of stress is present during working.

7. A method as claimed in claim 5, wherein the working comprises extrusion, swaging, or rolling.

8. A method as claimed in claim 1, wherein an extrusion, forging, plate, sheet or fastener stock product is formed.

9. A method as claimed in claim 8, wherein a rivet product is formed.

10. The product produced by the method of claim 1.

11. The product produced by the method of claim 8.

12. The product produced by the method of claim 9.

13. Aluminum alloy produced by a method as claimed in claim 1 having a shear strength greater than 100 MPa at 300° C. and a formability greater than 0.9 true strain, as measured at room temperature (22° C.) with a strain rate of 8.7 $sec^{-1}$.

14. Aluminum alloy as claimed in claim 13, consisting essentially of 4 to 12 wt.-% Fe, 2 to 14 wt.-% Ce, remainder substantially Al.

15. Aluminum alloy as claimed in claim 14, consisting essentially of about 8.3 wt.% Fe and about 4.0 wt.% Ce, remainder substantially Al.

16. Aluminum alloy as claimed in claim 13, in the form of an extrusion, forging, plate, sheet or fastener stock product.

17. Aluminum alloy as claimed in claim 13, in the form of rivet stock.

18. A high-strain-rate assembly of aluminum alloy components having a shear strength greater than 100 MPa at 300° C. joined by fasteners of aluminum alloy produced by a method as claimed in claim 1, the fasteners having a shear strength greater than 100 MPa at 300° C., the components being either neutral or else anodic with respect to the fasteners by no more than 20 millivolts as measured in an aerated 1-molar NaCl solution and by no more than 50 millivolts when measured in an aerated 3½ wt.-% NaCl solution.

19. A method comprising:

providing billet of aluminum alloy consisting essentially of 4 to 12 wt.-% Fe, 2 to 14 wt.-% Ce, remainder substantially Al, in a state in which working of the alloy is accompanied by an increase in formability, by means of a process including hot working the alloy to billet of reduced cross section; and cold working the alloy after the hot working, the cold working being marked by an increase in formability of the alloy.

20. A method as claimed in claim 19, the hot working comprising working at a temperature about in the range 450°–550° C.

21. A method as claimed in claim 19, the cold working comprising working at a temperature about in the range 10°–40° C.

22. An assembly as claimed in claim 18, wherein the fasteners are rivets.

* * * * *

UNITED STATES PATENT AND TRADEMARK OFFICE

CERTIFICATE OF CORRECTION

PATENT NO. : 5,154,780

DATED : October 13, 1992

INVENTOR(S) : M. K. Premkumar

It is certified that error appears in the above-identified patent and that said Letters Patent is hereby corrected as shown below:

Col. 4, line 5 Change "ratibs" to --ratios--.

Signed and Sealed this

Twenty-first Day of June, 1994

*Attest:*

Bruce Lehman

BRUCE LEHMAN

*Attesting Officer*

*Commissioner of Patents and Trademarks*